US005190093A

United States Patent [19]

Oliver

[11] Patent Number: 5,190,093

[45] Date of Patent: Mar. 2, 1993

[54] METHOD FOR CASTING IRON PIPE

[75] Inventor: Gene L. Oliver, Birmingham, Ala.

[73] Assignee: American Cast Iron Pipe Company, Birmingham, Ala.

[21] Appl. No.: 806,322

[22] Filed: Dec. 13, 1991

[51] Int. Cl.[5] ..... B22D 13/02; B22D 13/10

[52] U.S. Cl. ..... 164/118; 164/457; 164/458

[58] Field of Search ..... 164/118, 297, 128, 457, 164/458

[56] References Cited

U.S. PATENT DOCUMENTS

| | | | |
|---|---|---|---|
| 1,776,542 | 9/1930 | Carrington | 164/297 |
| 1,776,543 | 9/1930 | Carrington | 164/297 |
| 1,776,546 | 9/1930 | Carrington | 164/297 |
| 1,776,577 | 9/1930 | Carrington | 164/297 |
| 1,796,645 | 3/1931 | Carrington | 164/297 |
| 1,895,135 | 1/1933 | Rohn . | |
| 2,383,442 | 8/1945 | Bremer . | |
| 2,513,142 | 6/1950 | Carrington | 164/118 X |
| 2,797,459 | 7/1957 | Myers | 164/297 X |
| 3,506,060 | 4/1970 | Andrews | 164/118 |
| 3,716,094 | 2/1973 | Fuminier | 164/154 |
| 4,004,632 | 1/1977 | Fort et al. | 164/297 |
| 4,095,643 | 6/1978 | Farlow et al. | 164/301 |

FOREIGN PATENT DOCUMENTS

| | | | |
|---|---|---|---|
| 58-68461 | 4/1983 | Japan | 164/297 |

*Primary Examiner*—J. Reed Batten, Jr.

*Attorney, Agent, or Firm*—Kerkam, Stowell, Kondracki & Clarke

[57] ABSTRACT

In a process for centrifugal casting metal pipe in a metal mold in which the mold is cooled by the application of cooling water to the external surface, the application of cooling water is interrupted for a time just prior to the pouring of molten metal to a time generally corresponding to the time of separation of the pipe being cast from the inner surface of the mold to thereby permit limited dilation of the mold and reduce tensile stress in the external portion of the mold.

10 Claims, 6 Drawing Sheets

METHOD FOR CASTING IRON PIPE

BACKGROUND OF THE INVENTION

1. Field of the Invention

This invention relates to the centrifugal casting of iron pipe and more particularly to a process for centrifugally casting iron pipe in a metal mold which enables use of a lighter weight mold and extends the useful life of the mold.

2. Description of the Prior Art

The production of cast iron and ductile iron pipe by the deLavaud system incorporating permanent or semi-permanent metal molds and utilizing a centrifugal casting procedure is well known in the art as illustrated, for example, in U.S. Pat. No. 1,949.433. Such a system employs a pouring ladle for receiving the molten iron and accurately pouring a predetermined amount of the molten iron within a predetermined length of time into a fixed trough positioned on an incline to carry the molten metal to the mold contained within and rapidly rotated by the casting machine. The casting machine is reciprocated along a track in a rectilinear motion at a predetermined rate whereby the fixed trough is inserted into and withdrawn from the open end of the mold in the casting machine. Molten metal poured from the ladle flows from the trough and is deposited at a uniform rate into the mold during the withdrawal movement.

The typical deLavaud casting machine includes a water jacket surrounding the metal mold, with the mold being either submerged in a water bath in the jacket or with spray means provided within the jacket applying cooling water in high pressure streams onto the outer surface of the rotating mold. The metal mold is thus continuously cooled, either by the water bath or water spray, throughout each successive casting cycle. Each mold is formed from a high quality steel forging or casting which is precision machined to dimensions required for casting pipe of a standard size. Relatively close tolerances with respect to roundness and straightness are required because of the high speed of rotation necessary to centrifugally cast the molten metal. Also, the mold has wall thickness and strength requirements to prevent warpage and distortion due to the thermal stresses induced during the casting process. The mold thickness used in the commercial production of iron pipe is generally based upon achieving dimensional stability throughout an acceptable life span for the mold.

Mold thicknesses used in centrifugal casting of iron pipe vary with the diameter of the pipe being produced and generally are represented as a mold diameter to mold wall thickness ratio. For example, for casting pipe having a diameter of 4", this ratio may be about 6, with the ratio increasing to about 16 for 24" pipe whereas, for molds greater than 24" in diameter, the mold diameter to thickness ratio will generally remain within the range of about 18 to 22. Practical experience has shown that, for these ratios, molds accurately produced from a high strength steel will retain the required dimensional stability over an economically acceptable life span.

During the casting operation, the inside surface of the metal mold is rapidly heated while the outside surface is maintained at a relatively low temperature by the cooling water. For example, the inside surface of the mold may be heated to about 1300° F. within about one second after contact with the molten iron while the outside mold surface, being continuously cooled, will normally never exceed about 400° F., depending upon mold size and operating conditions. This severe temperature gradient through the mold wall results in high thermal stresses in the mold, with the inner portion of the mold wall being in a state of compression and the outer portion in tension. The compressive stresses on the inner portion of the mold are so great as to cause compressive yielding with plastic compressive strain during this high temperature phase of the molding cycle. A few seconds later, as the thermal gradient across the mold wall thickness reaches its maximum, the tensile stresses at the outer surface will also reach their maximum. This maximum tensile stress at the outer surface will occur when the difference between the mean mold temperature and the outer surface temperature are at a maximum.

As the cast pipe solidifies, an air gap will form between the outer surface of the solidifying casting and the inner surface of the mold, with a consequent substantial reduction in the thermal load, or heat flow, from the casting to the mold. When separation between the mold and casting occurs, the temperature of the inner surface of the mold begins to drop and compressive stresses are relaxed. Continued cooling results in the inner surface portion of the mold going into tension due to the previous compressive yielding and, with continued cooling, the tensile stresses build until they exceed the yield strength and plastic tensile strain results. Thus, during each casting cycle, the portion of the mold adjacent the inner surface undergoes compressive yielding followed by tensile yielding which eventually leads to failure by the formation of cracks on the inner surface. This type of failure is known as low cycle thermal fatigue, and continued use causes the inner surface cracks to grow until it becomes difficult to extract the casting from the mold, or the cracks may become so severe as to mar the surface of the casting to the extent that it is unacceptable from an appearance standpoint.

Molds may also fail by tensile yielding of the outer portion of the mold wall which produces mold warpage or out of roundness. This can occur with or without the presence of cracks on the inner surface, and is usually indicative of a mold formed from a material having relatively low yield strength or a mold having an improper wall thickness for the operating conditions. Operating conditions may be influenced by various factors such as casting rate, molten metal temperature, cooling rate and the like. Molds which fail as a result of outside tensile yielding generally cannot be economically repaired and must be scrapped.

In order to increase mold life by reducing thermal fatigue cracks on the inner surface, the range of compressive and tensile strain (strain range) must be decreased. The relationship between the strain range and the number of cycles to failure is a log-log relationship, with the consequence that a small decrease in the strain range may result in a substantial improvement in mold life. The strain range may be reduced by a wet spray process involving the application of a thin refractory wash sprayed onto the inner surface to reduce the thermal load by putting an insulating layer between the molten iron and the mold surface. While this technique extends mold life, it is not entirely satisfactory from a commercial standpoint in that it substantially reduces the production rate due to the extra time required to apply and dry the refractory lining on the inner surface of the mold before each casting cycle.

It is also possible to reduce the thermal load by reducing the pouring temperature of the molten iron but there are obvious practical limitations on the amount this temperature can be reduced and still successfully pour a sound casting. Casting of pipe having standard sizes and wall thicknesses thus essentially fix the thermal load.

Another technique to reduce the strain range is to decrease the mold wall thickness since a thinner mold has a lower strain range. As the mold wall thickness is decreased, the tensile stress on the outside surface increases, however, and plastic yielding of the outer surface fibers may occur, again placing a practical limitation on this method. In practice, molds having a diameter to wall thickness ratio within the ranges discussed above have been found to provide a practical compromise, while molds having a diameter to wall thickness ratio greater than about 25 may warp beyond use in less than 100 casting cycles using conventional casting techniques.

It is, therefore, an object of the present invention to provide an improved process for the centrifugal casting of cast iron and ductile iron pipe.

It is a further object of the invention to provide such a method which will greatly extend the useful life of the metal mold in which the pipe is cast.

It is a further object to provide such a process which will enable use of metal mold having thinner walls than previously used in commercial pipe molding operations.

Another object is to provide such a process in which the thermal stress across the mold wall thickness is reduced to thereby reduce the strain range in the mold wall during each casting cycle.

SUMMARY OF THE INVENTION

In the attainment of the foregoing and other objects and advantages of the invention an important feature resides in controlling the application of cooling water to the external surface of the mold to permit an increased temperature at the outer surface of the mold and thereby substantially reduce the compressive strain on the inner surface portion of the mold during initial stages of the casting cycle. Discontinuing cooling of the mold from a time just prior to pouring of the molten metal for a time sufficient to permit limited thermal expansion at the outer surface substantially reduces the tensile load in the outer portion of the wall. By permitting the outer portion of the mold wall to heat up by the natural flow of heat from the inner wall of the mold, the thermal gradient across the mold wall, and consequently the stresses at the outer surface of the mold, are lowered. Preferably cooling is delayed until the heat transfer rate between the casting and the mold is substantially reduced, at which time the stresses in the mold start to decline and cooling water can then be safely turned on to extract the accumulated heat from the mold without increasing the stresses at the outer surface beyond the yield point of the metal. This substantially reduces the difference between the mean mold temperature and the inside and outside surface temperature which, in turn, reduces the compressive strains on the hot inner surface and high tensile stresses on the cooled outer surface.

The length of time that the cooling water is withheld at the beginning of each casting cycle will of course depend upon the mold thickness. Due to lowered stresses resulting from delayed cooling, a thinner mold can be used without exceeding stress limits of the outside diameter fibers of the mold. Use of thinner molds results in faster cooling of the mold throughout, with the result that, by use of the delayed cooling in combination with thinner mold walls, an increased cycle rate can be accomplished.

DESCRIPTION OF THE DRAWINGS

The foregoing and other features and advantages of the invention will be apparent from the detailed description contained hereinbelow, taken in conjunction with the drawings in which.

DESCRIPTION OF THE PREFERRED EMBODIMENT

Figure 1:
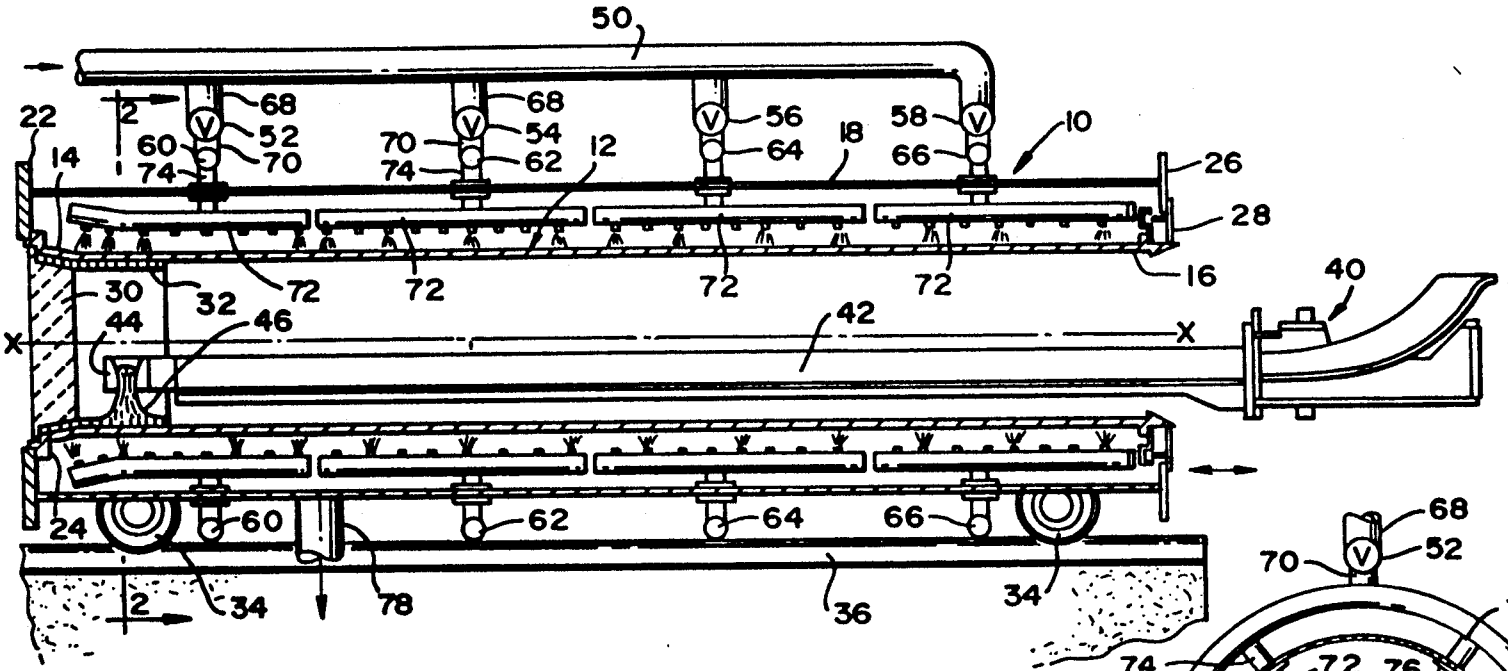
FIG. 1 is a fragmentary sectional view, in elevation, diagramatically showing apparatus suitable for use in practice of the present invention.
Figure 2:
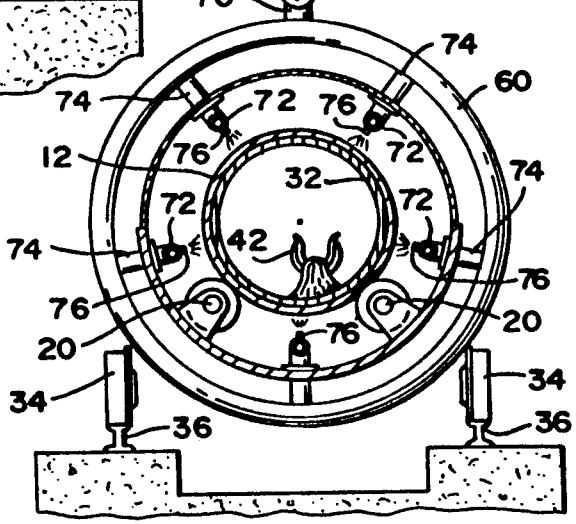
FIG. 2 is a sectional view taken along line 2—2 of FIG. 1.

Referring now to the drawings in detail, a casting machine for use in the centrifugal casting of iron pipe is schematically illustrated in FIGS. 1 and 2. The casting machine is indicated generally by the reference numeral 10 and includes a mold 12 having a bell end 14 and a spigot end 16 supported within a generally horizontal cylindrical housing 18. Mold 12 is supported for rotation about its generally horizontal axis X—X within housing 18 by a plurality of pairs of trunions 20 only one pair of which is schematically illustrated in FIG. 2. A flange 22 on housing 18 cooperates with a flange member 24 on the bell end of mold 12 to provide a seal and a second flange 26 and removable seal assembly 28 supported on the opposite end of housing 18 provides a seal with the spigot end of the mold. A removable head core or plug 30 is inserted into and supported on the bell end of mold 12 before each casting cycle, and defines the inner surface of the bell end of the pipe 32 being cast.

The mold and housing structure is supported for movement by wheels 34 along rails or tracks 36 to telescope the open or spigot end of mold 12 onto a molten metal delivery trough assembly indicated generally at 40 to position the discharge end of the trough 42 adjacent the head core 30 at the start of each casting operation. The ladle and molten metal supply system employed to deliver molten metal to the casting machine is not shown since such structure is well known in the prior art. As known, the molten metal is poured at a carefully controlled rate and flows along the trough to be discharged from the end 44 into the rapidly rotating mold 12 to initially fill the space between the core 30 and the inner surface of the mold to form the bell, then, as the stream 46 of molten metal continues to flow from the open end 44 the machine 10 is driven relative to the trough to withdraw the trough from the mold at a uniform rate. Conventional motor means, not shown, drive the wheels 34 to move the casting machine along the rails 36 and rotate the mold 12 about its axis at the necessary rate to provide centrifugal force to uniformly distribute the molten metal 46 around the inner circumference of the mold. Although the mold 12 and trough 40 are illustrated as being generally horizontal, it is understood that the trough may be inclined downward toward free end 44 to permit the molten metal to flow by gravity to the end 44.

As described above, prior art centrifugal pipe casting machines of this general type have conventionally employed continuous cooling to the external surface of the metal mold either by providing a bath within the housing 18 in which the outer surface of the mold 12 is partially or completely submerged or alternatively by continuously applying a spray of cooling water to its external surface. It is also known from U.S. Pat. No. 1,776,542 to avoid excessive chilling of the molten iron being cast to thereby avoid the necessity for annealing the pipe by applying cooling water to the external surface commencing with the pouring of the bell end of the pipe and progressing along the length of the pipe as the molten metal is poured. In this prior art system, cooling is also terminated progressively (from the spigot end) as the pipe is withdrawn with the result that substantially more cooling is applied to one end of the casting than the other with the consequence that the cast pipe inherently has different metallurgical characteristics along its length.

In accordance with the preferred embodiment of the present invention, a spray cooling system is employed to cool the outer surface of the mold 12. The spray system is illustrated schematically in FIGS. 1 and 2 as comprising a cooling water supply conduit or pipe 50 extending along the top and outboard of the housing 18. Cooling water is supplied by pipe 50 to a plurality of cooling stations along the length of the housing through quick acting, remotely controlled valve means 52, 54, 56 and 58 which, in turn, are connected to circumferentially extending manifolds 60, 62, 64 and 66. Since the cooling stations are substantially identical, only the cooling station supplied by valve 52 will be described in detail, it being understood that the description applies equally to the other cooling stations. It should also be understood that the number of cooling stations may vary depending upon operating conditions and the size of pipe being cast.

As most clearly seen in FIG. 2, water from supply pipe 50 is provided to valve 52 through a short conduit 68 and from valve 52 to manifold 60 through a connector pipe 70. A plurality of parallel, longitudinally extending spray bars 72 are disposed within and equally spaced around the housing 18 in outwardly spaced relation to the mold 12. Each spray bar 72 is connected, through a connector tube 74, to the manifold 60, and a plurality of spray nozzles or discharge outlets, indicated generally at 76, are provided along the length of each spray bar for directing cooling water onto the surface of the mold 12. Excess cooling water collecting in the bottom of housing 18 is removed through a suitable drain indicated schematically at 78 in FIG. 1.

Each of the valves 52, 54, 56, 58 may be actuated independently so that cooling water may be applied to the outer surface of the mold 12 commencing at different times as desired to accomplish the mold cooling in accordance with the present invention. It is also apparent that the apparatus may be employed to continuously supply cooling water to the outer surface of the mold in accordance with current commercial practice for the production of cast iron pipe, and that a greater number of cooling stations may be employed to provide cooling along the length of the pipe in shorter increments.

Figure 5:
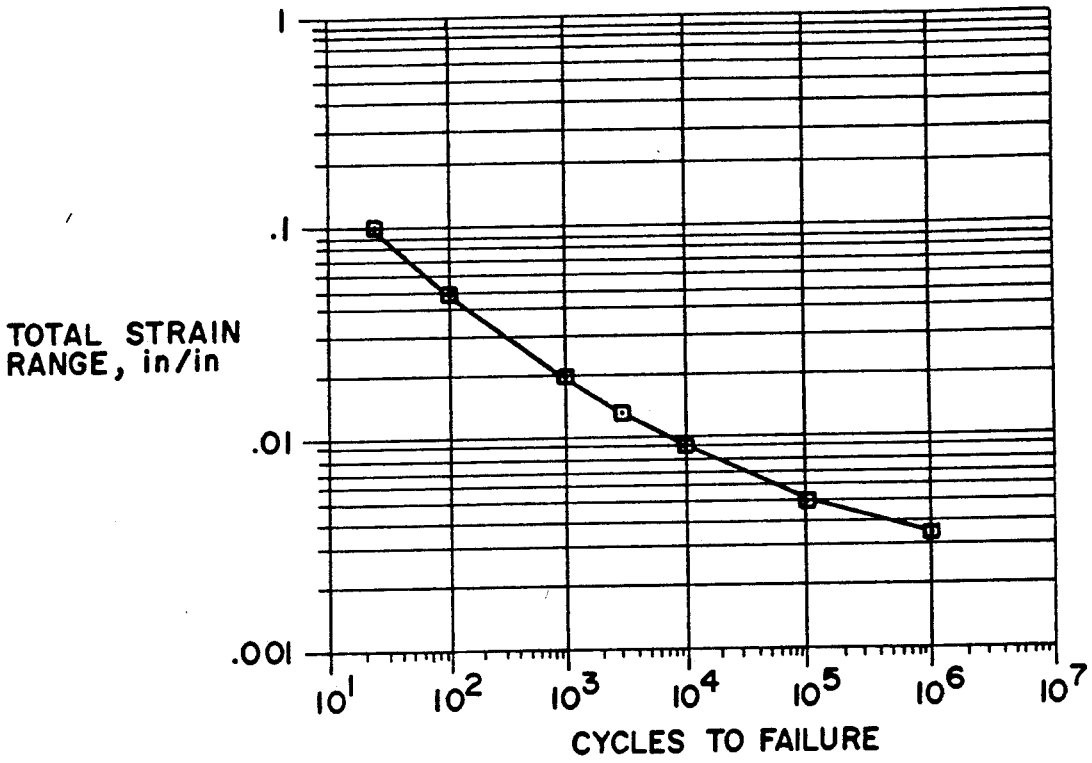
FIG. 5 is a graphic illustration of the strain range versus cycles to failure for a typical steel used for making centrifugal pipe casting molds.

As previously stated, the incidence of mold failure resulting from thermal fatigue cracks can be reduced and useful mold life extended by decreasing the range of the strain across the wall thickness. Since the strain range versus cycles-to-failure relationship is a log-log relationship, a small decrease in the strain range may result in a very substantial improvement in mold life. The effect of strain range on the cycles-to-failure for a typical steel of the type used to form pipe molds and cycled at 1,200° F. is shown in FIG. 5. For example, from this curve it is seen that for a strain range of about 0.047 in./in., the steel may be expected to fail in about 100 cycles while the life expectancy is increased to 1,000 cycles by reducing the strain range to about 0.02 in./in. Even greater life increases are achieved at lesser strain levels, however, and the curve indicates that for a strain range of about 0.005 in./in., failure would occur after 100,000 cycles while a reduction in the strain range to about 0.0036 will increase the life expectancy to about 1,000,000 cycles. It is, of course, unrealistic to expect a practical commercial pipe casting operation to employ a single mold for 1,000,000 cycles, but this curve does dramatically illustrate the improvement in mold life which may be achieved by reducing the strain range from thermal cycling during casting.

Figure 3:
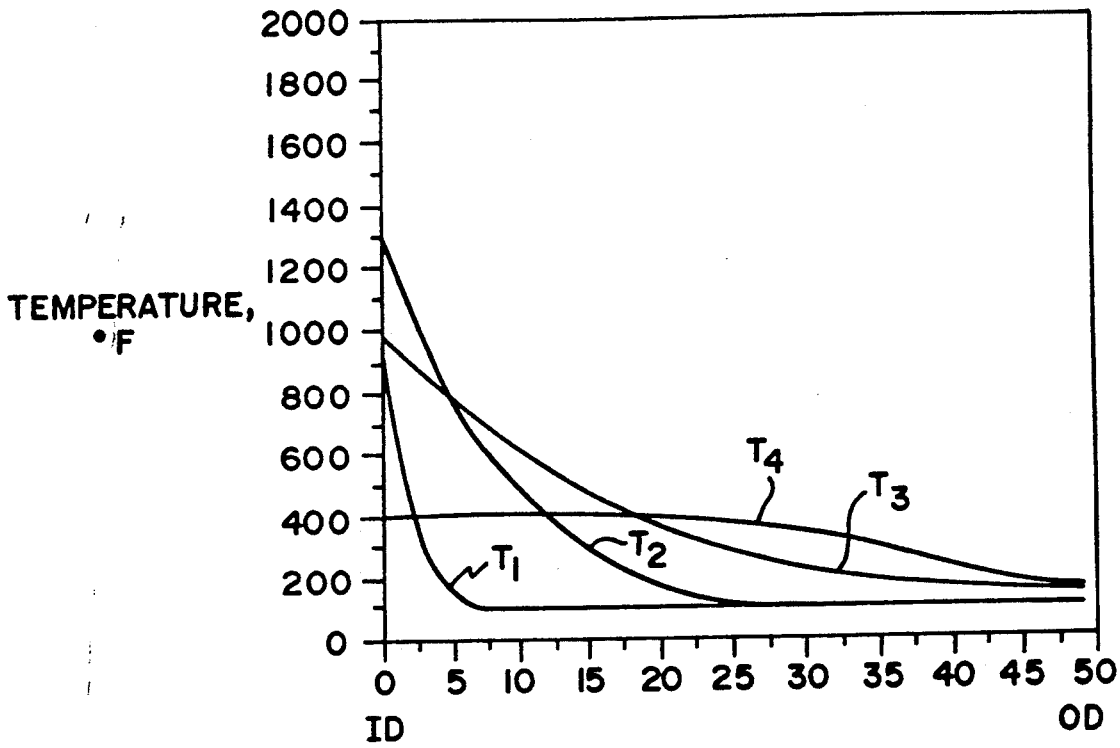
FIG. 3 is a graphic illustration of the radial temperature profile in a 42 inch pipe mold wall at four different times after contact with molten iron at the beginning of a conventional casting cycle.
Figure 4:
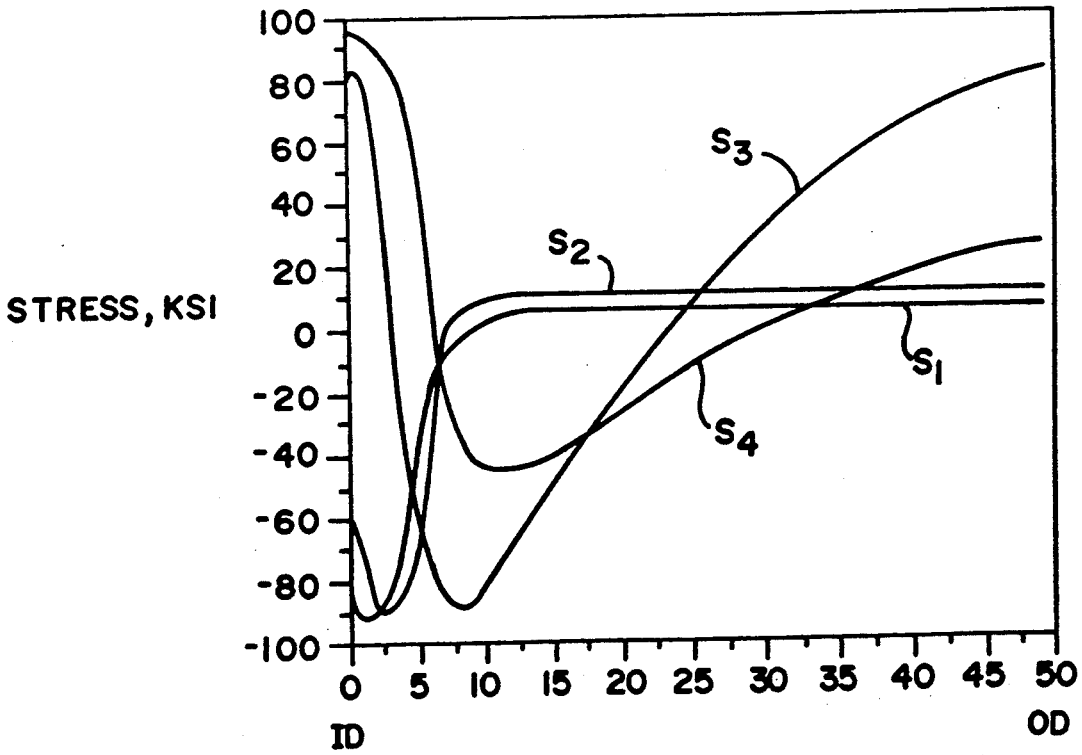
FIG. 4 is a graphic illustration of the tangential stress profile in the 42 inch pipe mold wall during a conventional casting process at times corresponding to the times of FIG. 3.

FIGS. 3 and 4, respectively, graphically represent the temperature profile and stress profile across the mold wall thickness of a steel pipe mold at four different times during a conventional deLavaud casting cycle in which cooling water is applied continuously. These temperatures and stress profiles are for a 42" pipe mold of the type employed by American Cast Iron Pipe Company, with the mold having a wall thickness of 2.18 inches. In FIG. 3, the temperature profile curves T1, T2, T3 and T4, respectively, represent the temperature at various locations through the mold wall at one second after pouring of molten iron into contact with the inner surface of the mold, at a time immediately before separation between the solidifying metal and the internal wall surface, at the time of maximum tensile stress at the outer surface of the mold, and after the cast pipe has been extracted from the mold, respectively. In FIG. 4, stress curves S1, S2, S3, and S4, respectively, represent the tangential stress in the mold wall at times corresponding to the times in FIG. 3. In FIG. 4, compressive stresses are negative while tensile stresses are positive.

As shown in FIG. 3, the temperature at the surface of the mold approaches 1,000° F. within about one second after contact with the molten iron due to the high heat transfer rate resulting from the intimate metal-to-metal contact between the molten iron and the inner mold surface. This high temperature at and adjacent to the surface of the mold initially results in an extremely high compressive stress in this portion of the mold wall as seen from FIG. 4.

When the molten iron initially comes into contact with the mold surface, a strong mechanical bond is formed between the thin skin of molten iron which solidifies at this interface, and this bonded metal-to-metal contact results in the high initial heat transfer rate. As heat is extracted by the relatively cooler mold wall, thermal contraction of the solidifying iron will result in this mechanical bond breaking and will produce an abrupt reduction in the heat transfer rate due to the separation of the casting from the mold wall. Temperature profile curve T2 and stress profile curve S2 show the temperature and stress relationship in the mold wall immediately prior to this separation or air gap formation. At this point, the mold inner surface temperature has reached its peak and compressive strains have reached their peak, although the stress immediately adjacent the inner surface has relaxed slightly as a result of lowered compressive yield strength at elevated temperature.

Shortly after separation of the mold wall and casting, the temperature of the mold inner surface will again drop to about 1,000° F. and the stress in this area will change from the previous high compression to a very high tension. Also, the difference between the mean mold temperature and the outside mold surface temperature has reached a peak which produces the maximum tensile stress at the outside mold surface. This condition is represented by temperature profile curve T3 and stress profile curve S3.

With continued cooling of the inner surface as a result of heat being absorbed by the cooling water applied to the outer surface, tensile stresses at the inner surface build up due to the previous compressive yielding until they exceed the yield strength and plastic tensile strain results. Thus, during each casting cycle, the inside diameter portion of the mold undergoes compressive yielding followed by tensile yielding, ultimately leading to failure by the formation of surface cracks, a condition referred to as "low cycle thermal fatigue".

As shown by curves T4 and S4, once the casting is stripped from the mold, the temperature of the mold quickly drops while the tensile stress near the inner surface remains very high. However, continued cooling of the mold by the application of cooling water to the outer surface in the absence of molten metal supplying heat to the inner surface will result in a return of the mold to a substantially uniform temperature prior to contact with the molten metal on the next casting cycle.

While limited plastic compressive and tensile yielding of the mold wall at its inner surface will ultimately produce stress cracks which will progress until they may interfere with stripping of the casting, or require repair by welding for strength purposes, some such cracking will not prevent continued use of the mold. In contrast, however, tensile yielding of the outer diameter portion of the mold will normally result in the mold becoming out-of-round. An out-of-round mold generally cannot be repaired and has to be scrapped.

Figure 7:
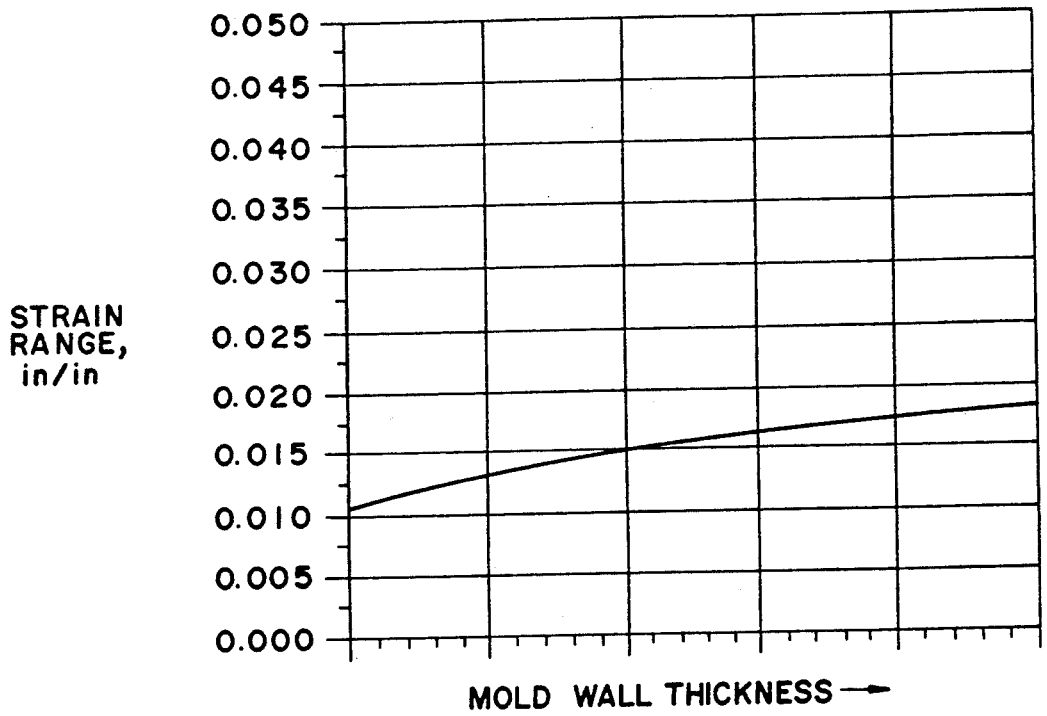
FIG. 7 is a graphic illustration of the effect of mold wall thickness on the range of strain at the inner surface of a conventional pipe casting mold.

As previously indicated with reference to FIG. 5, the total strain range in the mold wall versus the cycles-to-failure of the metal is a log-log relationship so that a small reduction in strain can produce a substantial increase in the useful life of a mold. As shown in FIG. 7, the strain range in a typical steel mold used for casting iron pipe will vary with the thickness of the mold wall in a conventional continuous cooling casting operation. In accordance with the present invention, however, the total strain range in the mold wall is reduced by delaying cooling of the external surface of the mold wall for a time sufficient to permit limited dilation of the external portion of the mold wall. Preferably, cooling is delayed until the thermal load to the interior surface of the mold is reduced by separation of the casting from the internal mold surface. By delaying cooling, the external surface temperature is permitted to increase, thereby relieving to some extent the initial compressive stress at and adjacent to the internal surface. As a consequence, subsequent tensile loads in the mold adjacent the outside diameter are decreased, again with a consequent reduction in total strain.

Figure 6:
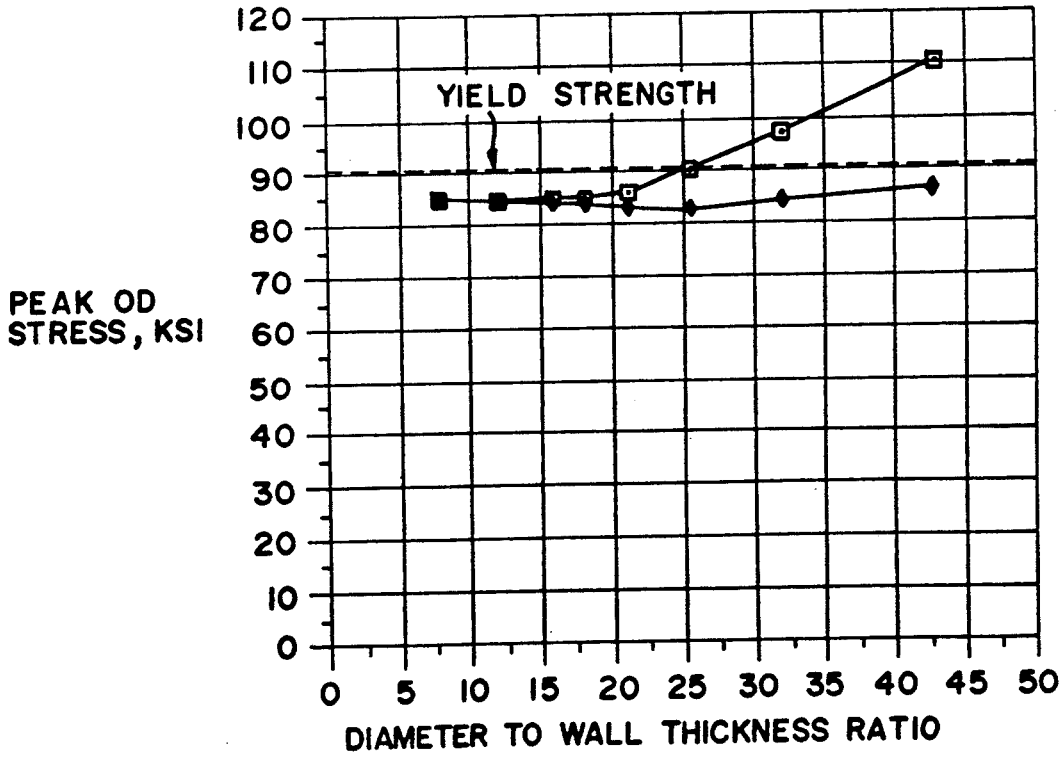
FIG. 6 is a graphic comparison of the mold wall stress versus the diameter to wall thickness ratio for a conventional continuous cooling casting process and for the delayed cooling process of the present invention.

As shown in FIG. 6, delayed cooling is more effective in reducing the total strain range in molds having relatively high diameter-to-wall thickness ratios. For example, a commonly used steel material employed for pipe molds has a yield strength of 90,000 psi. Stresses at the outside surface of a mold wall formed from this material and having a diameter-to-wall thickness ratio greater than about 25 will exceed the 90,000 psi yield strength during a conventional continuously cooled casting cycle whereas by delaying cooling for a time approximately equal to the time required for the casting and mold wall to separate and the difference between the mean mold temperature and the outside diameter surface temperature to reach its maximum value, the yield strength is not reached at the outside diameter for molds having a diameter to wall thickness ratio greater than 40. Thus, it is seen that delayed cooling enables the use of a mold having a thinner wall, i.e., a greater diameter to wall thickness ratio, while maintaining the outside diameter stresses below the yield strength of the material and thereby avoiding the danger of the mold going out of round due to plastic strain.

FIGS. 8 through 11 illustrate graphically the advantages to be gained by delayed cooling during a pipe casting operation. These curves compare various conditions and parameters for a 30" diameter deLavaud pipe mold operated to cast iron pipe using continuous cooling to the outside of the pipe mold and using delayed cooling to the mold, with all other conditions being equal. In these figures, the curves represent computer generated data from Casting cycles after the mold has been used for a number of cycles sufficient for the operating conditions to stabilize. As a rule, a minimum of three cycles are required for the mold temperature to stabilize.

Figure 8:
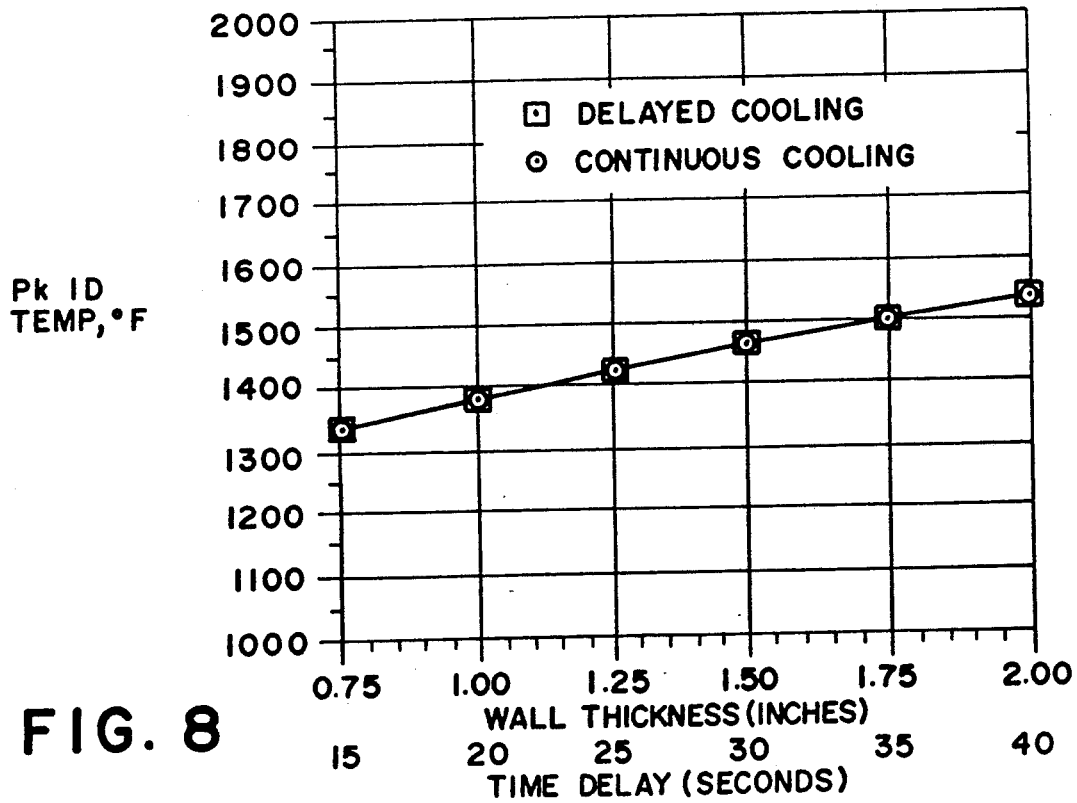
FIG. 8 is a graphic comparison of the peak inside diameter mold temperatures produced during pipe casting cycles using continuous cooling and delayed cooling of the mold.

As shown in FIG. 8, the peak inside diameter surface temperature of the mold is substantially identical for both the continuous cooling and delayed cooling technique, and this holds true regardless of the mold wall thickness, although the peak inside diameter temperature is substantially higher for molds having thicker walls. The heat wave from contact with the molten metal being cast does not pass completely through the mold wall for molds having a thicker wall until after separation between the casting and the internal mold surface, with the result that the heat build-up at the inner surface is greater for molds having a thicker wall. The thinner molds are able to dilate more, enabling the air gap to form slightly sooner with the result of a reduced tendency for stress failure cracks to form on the inner surface.

It is not always possible to accurately predict the exact time when the mechanical bond between the solidifying metal of the casting and the mold wall surface will be broken although the theoretical time can be calculated. This time will, of course, depend to some extent upon the thickness of the mold wall. Since it is desired to withhold cooling water for so long as the molten metal is in intimate contact with the inner surface of the mold and while the outside diameter surface stresses are increasing, cooling delay illustrated in FIGS. 8–11 was increased with the wall thickness of the mold, as shown.

Figure 9:
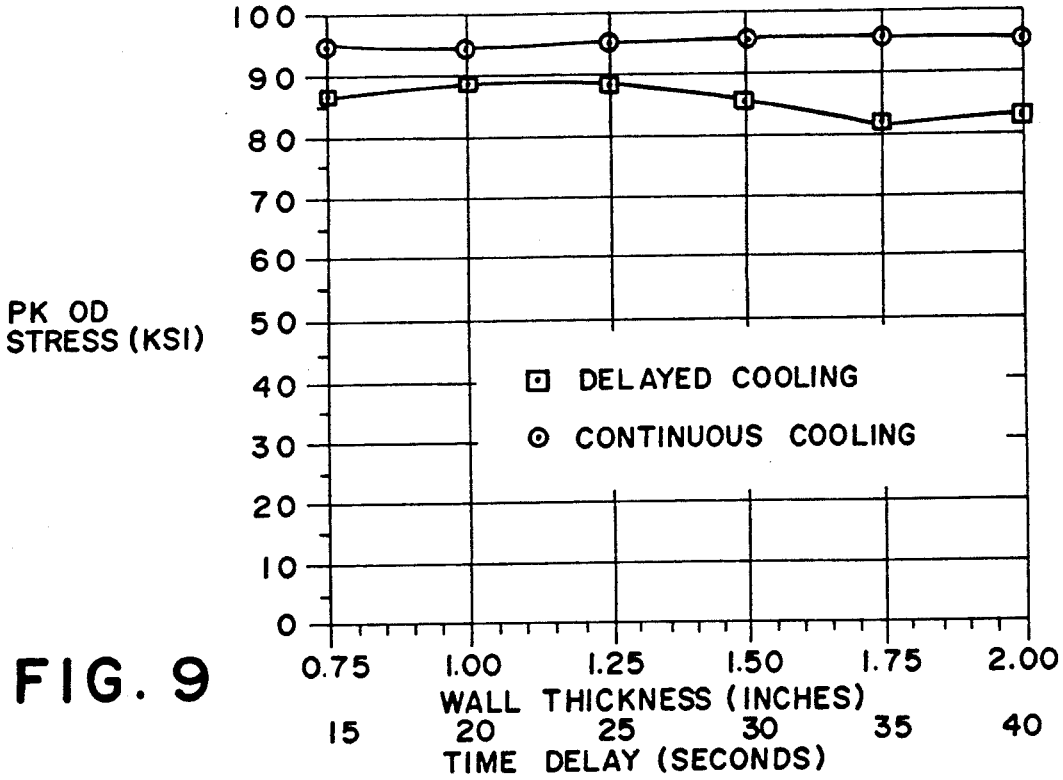
FIG. 9 is a graphic comparison similar to FIG. 8 showing the peak outside diameter mold stress.
Figure 10:
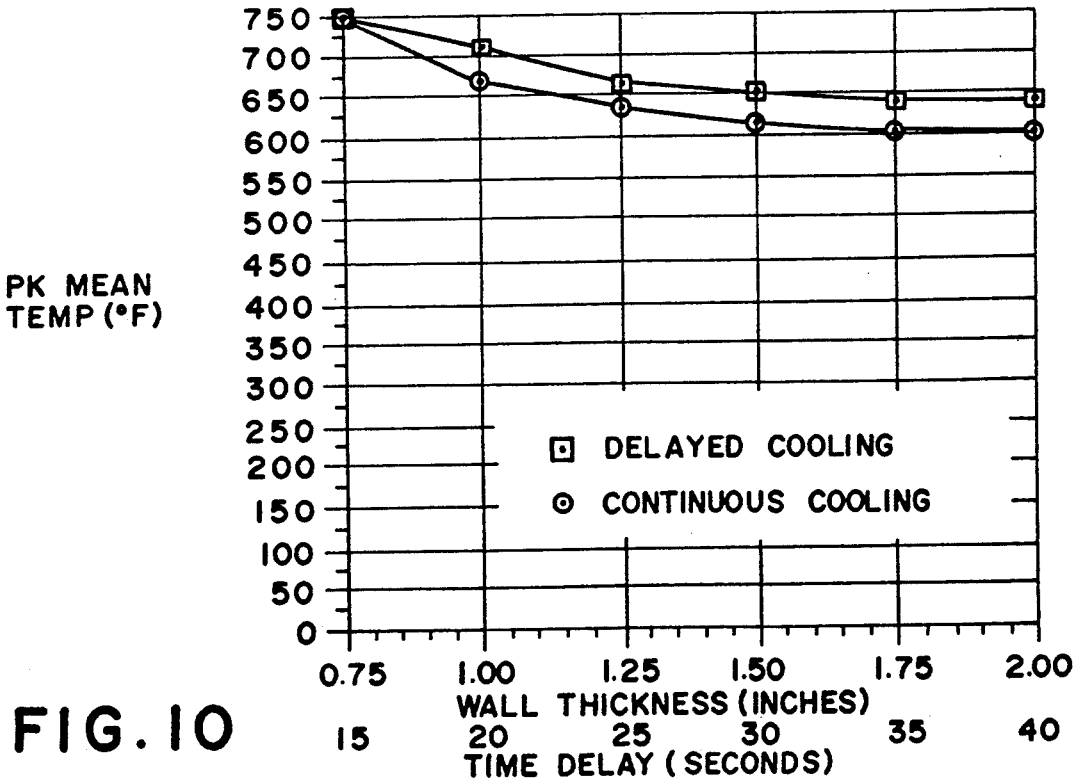
FIG. 10 is a graphic comparison similar to FIGS. 8 and 9 showing the peak mean mold temperatures.
Figure 11:
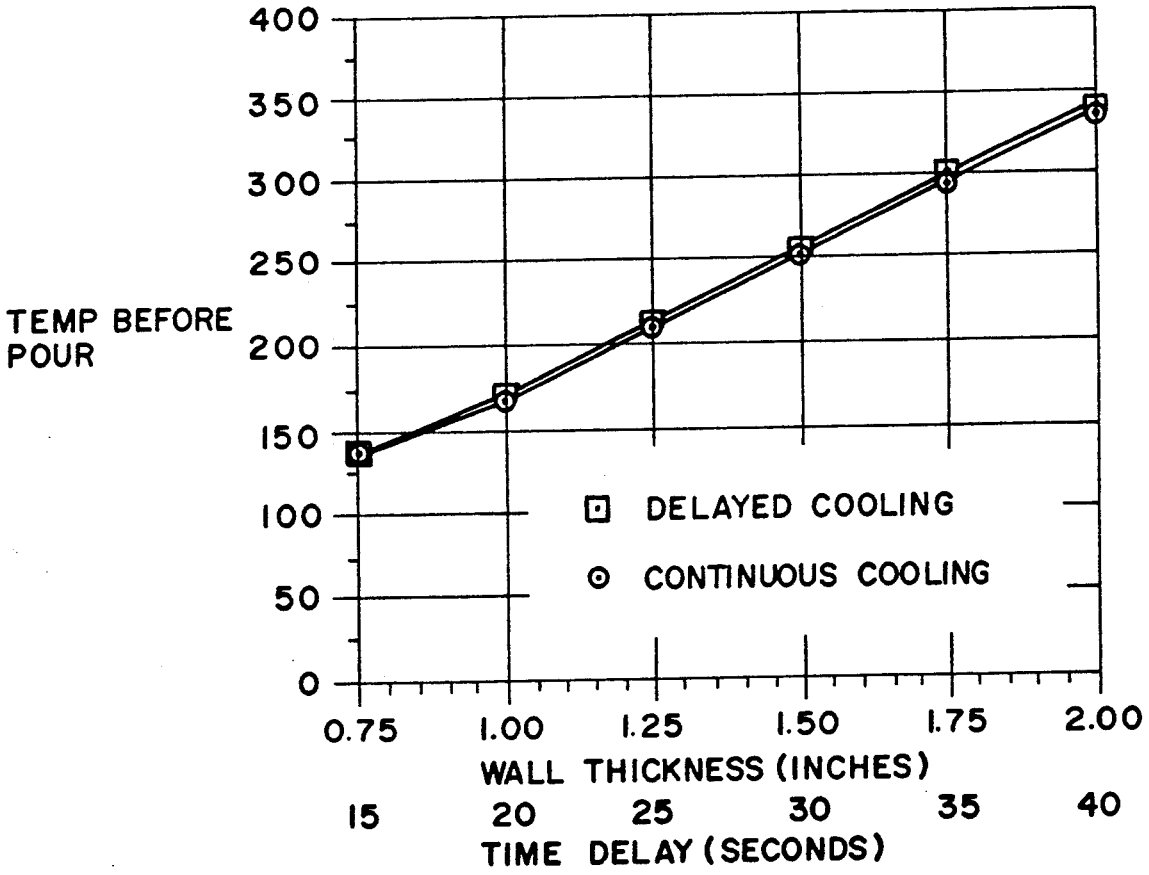
FIG. 11 is a graphic comparison similar to FIG. 10 showing the mean mold temperatures following completion of one casting cycle and just prior to commencing the next casting cycle.

FIG. 9 clearly shows that molds with continuous cooling have a higher peak outside diameter stress level than do molds with delayed cooling. The steel selected for the molds illustrated in FIGS. 8–11 had a yield strength of 95,000 psi so that stresses above this level would cause the outside surface fibers to yield on each continuous cooling casting cycle. As has been determined from prior experience, the cumulative effect of 50 to 100 cycles under these conditions can result in enough plastic strain to cause the molds to be dimensionally unstable and a number of molds of low strength materials have gone out of round in actual practice after very few cycles.

Under the casting conditions selected for FIGS. 8–11, the peak stress in the outside fibers of the mold wall will run consistently just above the 95,000 psi yield strength of the steel for each mold wall thickness using continuous cooling. By contrast, the maximum stress level at the outside diameter surface fibers for delayed cooling would be approximately 90,000 psi, or at least 5,000 psi less than continuously cooled molds so that yielding of the outside diameter surface fibers does not occur. It is also noted that delayed cooling of the thicker wall molds will result in substantially less stress at the outside surface. This clearly demonstrates the possibility of using thinner molds with delayed cooling while still maintaining dimensional stability.

A conventional 30" pipe mold used in a deLavaud casting machine by American Cast Iron Pipe Company has a wall thickness of 1.55" and is made from steel having a It can be shown that the strain range at the inner surface of such a mold used in a conventional, continuously cooled casting operation would be approximately 0.0206 in./in. and the strain range at a depth of 0.15" from the inner surface would be 0.0134 in./in. From the temperature curves of FIG. 8, it would be expected that essentially the same strain ranges would be encountered for such a mold using delayed cooling in accordance with the present invention. However, it is seen from FIG. 9 that the wall thickness of such a mold could be reduced to 1.0" if delayed water cooling is used without encountering yielding of the outer surface fibers. At the same time, the strain range at the inside surface of such a 1.0" thick mold is only 0.0178 in./in. and at a depth of 0.15" below the inside surface is 0.0089 in./in. Thus, the strain at the inner surface is substantially less for a 1.0" thick mold than for a 1.55" thick mold. Stated differently, by substantially reducing the weight of the mold a substantial improvement in mold life may be realized. Depending upon the type of steel and casting machine operating conditions, a mold life improvement of 25 to 50% might be expected, or this mold life could be traded for increased productivity if desired. Since the thinner mold will cool faster, the casting machine can be operated with a shorter cycle so that productivity increases of 15% to 25% might be achieved with strain ranges similar to those of standard molds used with continuous cooling.

The peak mean mold temperature bears a direct relation to and governs mold dilation during a casting cycle. Mold dilation, in turn, influences thermal stress. As seen from FIG. 10, a casting operation employing delayed water cooling in accordance with the present invention will result in a peak mean mold temperature of from 20° to about 40° F. higher than a mold of comparable thickness employing continuous water cooling. However, the difference between the peak mean mold temperature of a mold having a wall thickness of 1.5" operated with continuous cooling and a mold having a wall thickness of 1.0" operated with delayed cooling is about 100° F. While a 100° F. temperature change in the mold wall will not result in any significant change in the dimensions of the cast pipe, the dilation produced by such a change will significantly influence the thermal stresses encountered by the mold.

The mean mold temperature at the start of a casting operation, i.e., immediately before commencing pouring the molten iron, of a mold which is continuously cooled will run about 10° F. cooler than for a comparable mold employing delayed cooling in accordance with the present invention. However, as seen from FIG. 11, a 30" diameter mold having a 1" wall thickness employed in a delayed cooling process in accordance with the present invention will have a mean mold temperature immediately before pouring which is about 80° F. cooler than a mold having a wall thickness of 1.5" and employed in a continuously cooled process. The mold temperature at the start of a casting operation will have a direct influence on the stresses and strains induced during casting, with the cooler mold temperature resulting in lower stress and a lower inside diameter strain range. Conversely, by operating at a higher stress and strain level, a higher casting rate can be achieved with the thinner mold.

From the above, it is believed apparent that in the forming of cast iron pipe in a deLavaud pipe casting machine, by terminating the flow of cooling water to the external surface of the mold walls prior to commencing the pouring of molten metal into the mold and delaying the application of cooling water to the mold while the difference between the mean mold temperature and the temperature at the outer surface of the mold is still increasing, the tensile stress on the outer fibers of the mold wall can be substantially reduced and the useful life of the mold extended. Preferably, cooling of the mold is delayed for a time substantially equal to that in which the solidifying iron is in intimate contact with the inner surface of the mold and the difference between the mean mold temperature and the temperature at the outer surface of the mold is still increasing. Computer stress analysis shows that such delayed cooling can reduce the tensile hoop stresses at the outer surface of the mold by up to about 15,000 psi.

By delaying cooling of the mold in accordance with the present invention, molds having reduced wall thicknesses may be safely employed, thereby substantially reducing the cost of the molds. In addition, substantial economies may be realized from the increased mold life and accelerated casting rates.

While preferred embodiments of the invention have been disclosed and described, it should be understood that the invention is not so limited but rather that it is intended to include all embodiments which would be apparent to one skilled in the art and which come within the spirit and scope of the invention. For example, while the cooling system described employs four independently controlled cooling zones along the length of the mold wall, a greater number of such cooling stations may be employed. Ideally the application of cooling water could be initiated at the end of the mold where casting is commenced, then progress along the length of the mold at a rate substantially equal to the rate of casting with a time delay after pouring the molten metal allowing the heat wave to pass through the mold wall. The advantages to be obtained from such a complex progressive cooling system, however, are not believed to be sufficient to justify either the initial cost or the maintenance of such a system so that a staged cooling system such as described, with either more or less stations as required, will achieve the main objective of the present invention in most commercial pipe casting operations.

What is claimed is:

1. In a centrifugal pipe casting process in which individual metal pipes are cast in successive casting cycles in an elongated generally tubular metal mold by simultaneously rotating the mold about its longitudinal axis and moving the mold along said axis relative to a molten metal pouring trough while pouring metal from the trough into the mold progressively from one end of the mold to the other end thereof, applying cooling water onto the external surface of the mold to cool the mold and extract heat of fusion from the molten metal to solidify the pipe, extracting the solidified pipe from the mold and returning the mold to position for the next pipe casting cycle while continuing to apply cooling water to remove heat therefrom, the improvement comprising the step of discontinuing the application of cooling water to the external surface of the mold just prior to commencing pouring of molten metal into the mold, and delaying the application of cooling water to the external surface of the mold while pouring molten metal into the mold for a time to permit limited dilation of the pipe mold by heat absorbed from the molten metal to thereby reduce the tensile stress at the outer surface of the mold, and then commencing the application of cooling water to the external surface of the mold and continuing the application of cooling water until just prior to commencing the next pouring cycle.

2. The process defined in claim 1 wherein the delay in the application of cooling water following commencing pouring of the molten metal is substantially equal to the time required for the solidifying molten metal to separate from the internal surface of the mold wall.

3. The process defined in claim 1 wherein the delay in the application of cooling water is continued for substantially the entire period following the pouring of molten metal into the mold while the difference between the mean mold temperature and the temperature at the outside surface of the mold is increasing.

4. The process defined in claim 1 wherein said cooling water is initially applied to the external surface of the mold at a first cooling zone adjacent said one end, then progressively expanding the application of cooling water from said first cooling zone along the full length of the mold at a rate generally corresponding to the rate of movement of the mold along said axis.

5. The process defined in claim 4 wherein said cooling water is applied to the external surface at a plurality of cooling zones along the length of said mold in succession from said one end.

6. The process defined in claim 5 wherein said cooling water is applied to the external surface of said mold in at least four independently controlled cooling zones.

7. In a centrifugal pipe casting process in which individual metal pipes are cast in successive casting cycles in an elongated generally tubular metal mold by simultaneously rotating the mold about its longitudinal axis and moving the mold about said axis relative to a molten metal pouring trough while pouring metal from the trough into said mold progressively from one end of the mold to the other end thereof, applying cooling water to the external surface of the mold to cool the mold and extract heat of fusion from the molten metal to solidify the pipe, and extracting the solidified pipe from the mold and returning the mold to position for the next pipe casting cycle while continuing to apply cooling water to remove heat therefrom, the improvement wherein said cooling water is applied to the external surface of the mold from a plurality of spray stations supported externally of the mold and for movement therewith along the longitudinal axis of the mold, said spray stations being located adjacent one another in succession along the length of the mold, independently controlling the application of cooling water from each spray station, discontinuing the application of cooling water from all said spray stations immediately prior to the pouring of molten metal into the mold, commencing the application of cooling water to the external surface of the mold from a first of said spray stations adjacent said one end of the mold only after limited dilation of the pipe mold by heat absorbed from the molten metal to thereby reduce the tensile stress at the outer surface of the mold, and thereafter commencing the application of cooling water spray from each of the remaining spray stations in succession progressively from said first spray station.

8. The process defined in claim 7 wherein the application of cooling water to the external surface of the mold wall at each spray station is delayed throughout at least a major portion of the time during which the difference between the mean mold temperature and the temperature at the outside surface of the mold is increasing following the pouring of molten metal therein.

9. The process defined in claim 7 wherein the application of cooling water at each spray station is commenced substantially at the time of separation between the pipe being cast and the inner surface of the mold wall at that station.

10. The process defined in claim 9 wherein cooling water spray is applied to the external surface of said mold from at least four spray stations along the length of the mold.

* * * * *